US009526968B2

(12) United States Patent
Foley

(10) Patent No.: US 9,526,968 B2
(45) **Date of Patent: *Dec. 27, 2016**

(54) INTERACTIVE GOLF GAME WITH AUTOMATIC SCORING

(71) Applicant: Thomas P. Foley, Ocean City, MD (US)

(72) Inventor: Thomas P. Foley, Ocean City, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/546,407

(22) Filed: Nov. 18, 2014

(65) Prior Publication Data

US 2015/0072796 A1 Mar. 12, 2015

Related U.S. Application Data

(60) Continuation-in-part of application No. 14/472,859, filed on Aug. 29, 2014, which is a division of application No. 12/334,190, filed on Dec. 12, 2008, now Pat. No. 8,870,671.

(51) Int. Cl.

| | |
|---|---|
| ***A63B 67/02*** | (2006.01) |
| ***A63B 71/06*** | (2006.01) |
| ***A63B 53/00*** | (2015.01) |
| ***A63B 37/00*** | (2006.01) |

(52) U.S. Cl.

CPC ..... *A63B 71/0669* (2013.01); *A63B 37/0003* (2013.01); *A63B 53/00* (2013.01); *A63B 57/357* (2015.10); *A63B 57/40* (2015.10); *A63B 67/02* (2013.01); *A63B 71/0616* (2013.01); *A63B 71/0622* (2013.01); *A63B 60/16* (2015.10); *A63B 2053/005* (2013.01); *A63B 2220/17* (2013.01); *A63B 2220/801* (2013.01); *A63B 2225/15* (2013.01); *A63B 2225/20* (2013.01); *A63B 2225/54* (2013.01)

(58) Field of Classification Search

CPC ..... A63B 24/0021; A63B 2225/54; A63B 2225/50; A63B 2225/15; A63B 2102/32; A63B 71/0669; A63B 2024/0037; A63B 43/00; A63B 2220/17; A63B 67/02

USPC ..... 473/150–155, 176, 192, 169, 221–225

See application file for complete search history.

(56) References Cited

U.S. PATENT DOCUMENTS

| | | | |
|---|---|---|---|
| 1,840,406 | A | 1/1932 | McEvoy |
| 3,104,879 | A | 9/1963 | Jetton |
| 3,436,076 | A | 4/1969 | Barthol |
| 3,868,692 | A | 2/1975 | Woodard et al. |
| 3,891,221 | A | 6/1975 | Gordon |
| 4,040,236 | A | 8/1977 | Siler, Jr. et al. |

(Continued)

OTHER PUBLICATIONS

BPS Technology "Radargolf," Radar Corporation, 2817 Crow Canyon, Suite 203, San Ramon, CA 94583; http://www.radargolf.com/; (6 pages).

*Primary Examiner* — Mark Graham
(74) *Attorney, Agent, or Firm* — Blank Rome LLP; Michael C. Greenbaum; Matthew Esserman

(57) ABSTRACT

A golf game system is provided, including at least one ball, at least one club and at least one hole area. The club has a striking sensor for sensing a striking action of the club on the ball, and a score display for displaying a score related to the striking action. The hole area has a tee for placing the ball and a hole for receiving the ball, wherein the hole has a ball-in-the-hole sensor for communicating with the club. Scores are automatically printed for players at game conclusion, and club scores are erased to allow reuse by subsequent players.

15 Claims, 6 Drawing Sheets

(56) References Cited

U.S. PATENT DOCUMENTS

| | | | | |
|---|---|---|---|---|
| 4,220,992 | A | 9/1980 | Blood et al. | |
| 4,660,039 | A | 4/1987 | Barricks et al. | |
| 4,879,651 | A | 11/1989 | Little, Jr. | |
| 4,940,236 | A | 7/1990 | Allen | |
| 4,991,850 | A | 2/1991 | Wilhlem | |
| 5,056,106 | A | 10/1991 | Wang et al. | |
| 5,132,622 | A | 7/1992 | Valentino | |
| 5,354,052 | A | 10/1994 | Nicholls et al. | |
| 5,370,389 | A | 12/1994 | Reising | |
| 5,487,542 | A | 1/1996 | Foley | |
| 5,582,550 | A | 12/1996 | Foley | |
| 6,196,932 | B1 | 3/2001 | Marsh et al. | |
| 6,299,553 | B1 | 10/2001 | Petuchowski et al. | |
| 6,884,180 | B2 | 4/2005 | Corzilius et al. | |
| 6,974,391 | B2 | 12/2005 | Ainsworth et al. | |
| 7,040,998 | B2 | 5/2006 | Jolliffe et al. | |
| 8,870,671 | B1 * | 10/2014 | Foley | A63B 43/004 473/153 |
| 2007/0167247 | A1 | 7/2007 | Lindsay | |
| 2009/0111602 | A1 * | 4/2009 | Savarese | A63B 24/0021 473/283 |
| 2014/0100052 | A1 * | 4/2014 | Deng | A63B 53/047 473/282 |
| 2014/0329618 | A1 * | 11/2014 | Lindsay | A63B 37/0052 473/353 |

* cited by examiner

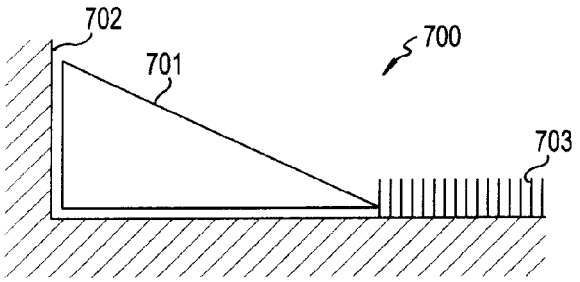
FIG. 7
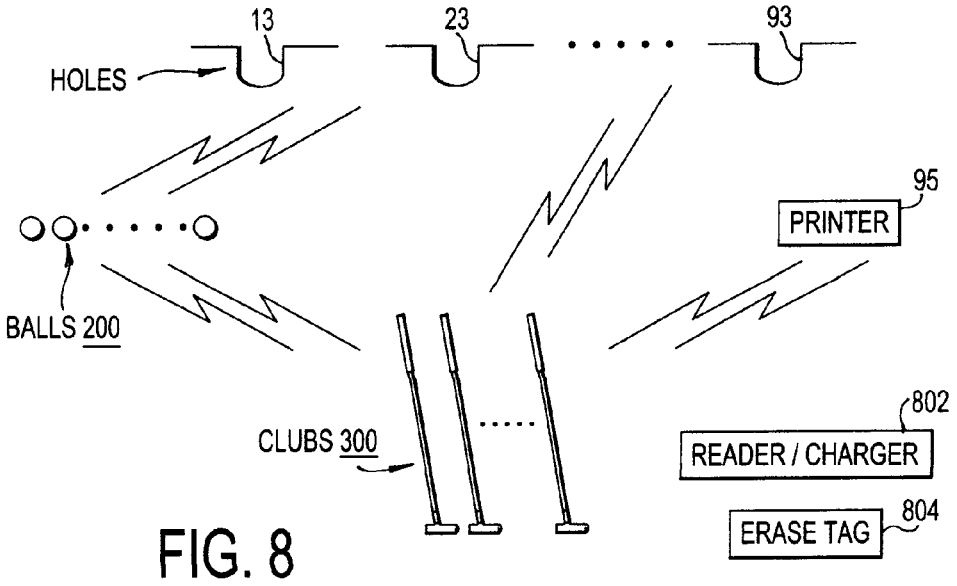
FIG. 8
| 1020 | 1010 | | 1030 |
|---|---|---|---|
| 1022 | 1012 | 1014 | 1032 |
| LEFT REGION | CENTRAL REGION | | RIGHT REGION |
FIG. 10

INTERACTIVE GOLF GAME WITH AUTOMATIC SCORING

REFERENCE TO RELATED APPLICATIONS AND PATENTS

The present application is a continuation-in-part of U.S. patent application Ser. No. 14/472,859, filed Aug. 29, 2014, currently pending, which is a division of U.S. patent application Ser. No. 12/334,190, filed Dec. 12, 2008, now U.S. Pat. No. 8,870,671. The present application is also related to U.S. Pat. No. 5,487,542, filed Mar. 21, 1995, and issued on Jan. 30, 1996, and U.S. Pat. No. 5,582,550, filed Jan. 16, 1996, and issued on Dec. 10, 1996. The entire disclosures of the above-noted applications and patents are hereby incorporated by reference into the present disclosure.

FIELD OF THE INVENTION

The present invention relates to a type of game that has at least one ball, one club, and one hole into which the ball may fall. More specifically, the present invention relates to an interactive golf game where a score is automatically displayed on the club, and printed when the game is completed.

BACKGROUND OF THE INVENTION

Mini golf has been a popular game for many years, with courses typically having 9 or 18 holes. Scoring is usually written manually by each player, which slows the game and sometimes bores the players. There is a need for an inexpensive system that can be readily added to existing mini golf courses, without rebuilding of the courses, which can automatically display the scores on the club to speed up the game and increase the player's enjoyment.

The play includes a number of structures placed on grounds where the public may visit for sport and entertainment. Each structure generally consists of a 12" square fiber or rubber tee mat, with a generally synthetic length of material used as a "green", ending in an area where a golf hole is embedded. Short vertical barriers of wood or other hard material are used along the sides of the "green" area, to prevent balls from leaving the preferred area of play. The "green" area may be straight or curved, or sloped at different sections, or may contain obstacles which must be circumvented or played through by the player's putting skill, to achieve progress of the ball from the tee into the hole. Individual players may play for practice, or several may play the course together as a group in competition with each other for achieving the lowest score of all holes played. The course may consist of any number of tee-green-hole combination structures, generally called holes. The most common number is 18 holes, although more or less may be used, depending on course space available. For illustration herein, a 9-hole course will be assumed. Each playing hole will be assigned a PAR score, which is the expected number of putting strokes that a proficient player will take to putt the ball from the tee into the hole. At the final hole, the ball is generally captured and held in a holding area, for its ultimate collection by an attendant to be used again by subsequent players. In its present form, each player manually transcribes the number of strokes taken at each hole onto a scorecard, to allow him/her to compare scores with others in the group, to determine which player has won the contest by the least number of aggregate scores recorded at each hole on the course.

Several U.S. patents are concerned with the field of the invention, such as:

Nicholls et al, U.S. Pat. No. 5,354,052, shows a golf course hole-in-one detector.

McEvoy, U.S. Pat. No. 1,840,406, shows a mechanical stroke counter attached to a golf club. The counter is augmented when a ball is struck.

Reising, U.S. Pat. No. 5,370,389, discloses golf balls which include bar codes for identification of the individual balls. A computer 118 is connected to a plurality of sensors.

Valentino, U.S. Pat. No. 5,132,622, shows a golf ball having a metal center which is magnetically detectable.

Wang et al, U.S. Pat. No. 5,056,106, shows radio location of golf course positions using different radio frequencies.

Gordon, U.S. Pat. No. 3,891,221, shows a magnetic golf ball. The magnetic properties of the ball are not used for sensing.

Jetton, U.S. Pat. No. 3,104,879, shows cables running to a central computer from various golf holes having golf ball sensors.

Golf clubs with impact sensors are disclosed by Wilhelm, U.S. Pat. No. 4,991,850, and by Allen, U.S. Pat. No. 4,940,236. Both employ piezoelectric sensors in the golf club head to register impact against golf balls. The sensors do not appear to distinguish between impacts with golf balls and other objects.

Other U.S. Pat. Nos. are: U.S. Pat. No. 5,056,106 to Wang et al; U.S. Pat. No. 3,436,076 to Barthol; U.S. Pat. No. 3,868,692 to Woodward et al; U.S. Pat. No. 4,220,992 to Blood et al; U.S. Pat. No. 4,660,039 to Barricks et al; and U.S. Pat. No. 4,879,651 to Little.

The prior art does not disclose any device which allows automatic score-keeping interactive with game players, which can be readily added to existing courses at low additional cost.

SUMMARY OF THE INVENTION

Accordingly, the present invention has an object, among others, to overcome deficiencies in the prior art such as noted above.

A golf system is provided, including at least one ball, at least one club and at least one hole area. The ball contains a passive electronic device. The club has a striking sensor for sensing a striking action of the club on the ball, and a score display for displaying a score related to the striking action. The hole area has a tee for placing the ball and a hole for receiving the ball, wherein the hole has a ball-in-the-hole sensor for communicating with the club.

Another aspect of the invention is the detail of the club. The invention provides that the club has a shaft having a first end and a second end; a head attached to the first end of the shaft, the head having a striking sensor for sensing an action of the head striking the ball; and a handle attached to the second end of the shaft, having a score display for displaying a score related to the striking action of the head.

Yet another aspect of the invention is a method for displaying scores of a golf game. The method includes the steps of: providing at least one ball; providing at least one club having a striking sensor for communicating with the ball, and a score display for displaying a score related to a striking action by the club; providing at least one hole for receiving the ball; providing a means of sensing the conclusion of play on each hole; and displaying a progressive score on the score display during the game play.

A further aspect of the invention is a method of automatically printing scores when the game is completed, and downloading all stored scores to a printer which is instrumented to receive and print such scores.

Other embodiments of the invention include the following:

1) The putting clubs are sealed to protect them from weather conditions and hard use by players. Since the club may be powered by rechargeable batteries contained therein, a recharging device has been developed for multiple clubs. Each club may be hung vertically by its putter head, which contains positive and negative contacts for recharging, and also contains an LED signal device for each club to indicate the charge level. Clubs are easily inserted into the charger and easily removed when fully charged. In one embodiment, up to 18 clubs are housed in a small charger; several may be used for a larger number of clubs to be charged at the same time. Alternatively, inductive charging could be implemented.

2) The score download is used in order to allow score sheet printing and to library record the scoring via internet connection to a dedicated website. A club reader has been developed to perform several functions:

a) to read the status of club charge prior to allowing a player to use the club for play;
b) to identify the club, presently by reading an attached bar code, which will start a clock for re-reading the start time;
c) to download all hole-by-hole and sum scores and time of play for each player, and the play complete time;
d) to preserve all daily and weekly play scoring, for owner audit of play;
e) to read the status of charge after play, which will determine whether the club can be re-used for further subsequent play, or should be recharged.

3) The club is programmed to erase all stored "marriages" and scores when its putter head is held near an "erase" RFID tag, for further subsequent player use. This allows clubs to be used repeatedly for subsequent players.

4) An alternative method has been implemented of determining when the recorded scoring on a hole is complete. Each individual tee plaque RFID tag has been recorded separately in the club to allow the microprocessor to recognize that a tee tag different from the previous one has been detected. When this new tag is detected, this fact causes the club to cease recording strokes on the previous hole storage, preserve such hole sum for later print and web recording, and open a new storage location for the next observed tee plaque RFID tag. This eliminates the need for any ball-in-hole transmitting device to signal the club that scoring on a hole has been completed.

In at least one embodiment, the system comprises five components:

1. A number of golf putting clubs, containing an LED score display atop the club handle, which is permanently attached to electronics and rechargeable batteries within the club, with wires through the hollow club shaft to connect to an electronic device permanently attached between the putter head and the club shaft. This device contains a piezoelectric impact sensor with associated electronics and a coil used as the RFID transmitter and receiver. The putter head also contains positive and negative contacts to allow recharging of the club's batteries. The electronics will contain a microprocessor with memories to allow the programming of functions for the club to perform—such functions will be described later to illustrate how the MSC (MINI-MATIC SMARTCLUB) game plays.

2. A number of golf balls, of different colors, each contain a different passive RFID tag for responding its digital identity to the club's transmission when in the proximity of the ball.

3. A number of tee plaques (nominally 9 or 18) each containing different passive RFID tags, embedded underneath the rear edge of each tee square, to respond to a club's transmissions when the club is in proximity of the tee.

4. A club reader with a printer, and electronics to allow downloading of the putting scores of each golf hole played, when the club is placed on the reader. The reader's output may also be connected to a phone or cable line to a remote server for retention of a library of all play at that course by date and time. The status of battery charge is also displayed by the reader to determine whether the club can be used again by a subsequent player, or should be recharged.

5. A charging rack, which will hold and recharge a number of clubs, with signals showing the recharge state of each of the clubs, so that those clubs fully charged can be used by players.

The game play is as follows: Each player pays for play, and selects a charged club and a selected color MSC golf ball. The group may proceed to a "practice green" area, where they can practice putting before playing the game. The clubs are programmed to ignore any such practice putts, since their programming will only allow strokes to be stored and displayed on the handle readout after a tee plaque RFID has been read by the club. Players then proceed to the first tee, where one in the group places an assigned ball in the center of the 12" by 12" tee, sets the club behind the placed ball, and views the direction to the hole. As the player draws the club back to initiate the stroke, the club reads the RFID response of the tee, and allows an electronic gate to open within the club. As the club approaches the ball, the ball's RFID responds to the club, causing a coinciding electronic gate to open anticipating a response from the club's impact sensor, which will then allow the stroke to be registered, displayed and stored in memory. The display will then show 01. The club will then store the ball's RFID code, and will subsequently respond only to this ball's code, in exclusion of any other RFID code. At this point, the club has "married" that ball for the duration of the game, until its memory is later erased after score printing and website recording. Other players then take their first stroke, with their clubs performing similarly.

Generally, the ball farthest from the hole is to be putted next. The player takes the next stroke with the club recognizing its "married" ball, storing and displaying 02 on its display. Other players continue to stroke their balls, with accumulating scores shown on their displays and stored in their club's memories, until all have putted their balls into the first hole, and removed them before proceeding to the next tee. As each player strokes their balls, each club recognizes the new tee, which signals each to close the scoring on the previous hole, retain it in memory, and open a new memory location for the second hole.

The process repeats for each player at each hole, until the completion of play on that course. Usually, golf balls are retained in a storage location connected to the final hole. Players then return their clubs to the attendant for score downloading and score printing, and ultimate erasure to allow the club to be used anew by subsequent players. While printing each player's score, every play is also recorded within the reader for each of the past seven days, to allow the course owner to use a memory stick download of each week of play by the course owner. Since the output of the reader is also connected to the website, it is also possible to determine a player's handicap for miniature golf, by the website comparing the player's scores to the established PAR for each hole and/or sum for the course. Players can be identified by their website address, and can send their scores, date and time of play at an MSC location from their score sheets. Their handicap can be determined, maintained and used by players for competitive play in tournaments. Such tournaments can be conducted at each local course by single players, or by teams competing. Tournaments can also be conducted between courses, since the handicaps and scores can be maintained and be available at the website.

In some miniature golf courses, a 19th, or "extra" hole is used to collect all the balls, by allowing the player to hit their ball into a difficult target, the success of which wins the player an award, usually a "free" subsequent game, or a small trophy. The MSC will contain an embedded RFID plaque in the extra hole tee, which the club will be programmed to prevent score from being recorded or displayed for the stroke(s) taken. This is done to preserve the actual competitive scores of all the previous 9 or 18 holes on the display, and in the memory for later printing and internet library storage. Such "no-score" RFID tags may also be used within each of the courses' golf holes, to allow players to dip their club heads into the hole after initial completion of that hole play, for the purpose of allowing that player to "practice" the last stroke(s) of the hole, without adding to the score stored in memory and displayed. As the player resets his/her ball on the next tee, the club's recognition of that tee's RFID will allow normal game scoring to proceed.

The advantages of the present invention in at least some embodiments over manual scoring are:

Its design is PROTECTED by a registered patent, trademark and website to retain a library of all play at each course. The registered website also allows communication with the public for advertising new course locations, tournaments and other special events.

It is READY for use and adaptable to any existing or planned course without any structural changes to the course, and can usually be installed in an hour. Owners can just replace all the balls and clubs, place electronic tee plaques on each tee, replace club storage racks with recharge racks, and place the readout station at the attendant's counter, with the printer accessible to players.

It is OPERABLE by all players. It's interactive, simple and fun to use. Players will enjoy seeing their current scores in bright LED displays on the top of their club handles. Every time they stroke their ball, they'll see their score change, and they can compare scores with others in their group. When they complete play, they get a printed score sheet, showing their scores at each hole, and their total for the course, which will be innovative to all players, young and older.

The play is FASTER. With no scores to write down, players will move through the course more quickly, reducing the waiting time for others to play. This will result in greater profit for course owners during busy times.

Also, the cost is INEXPENSIVE. An MSC set will retail for a low price, which is a small investment for every existing course, and should be well worth it, considering the increased business profit that will result from its use. For new courses, the investment will even be less, since the new MINI-MATIC SMARTCLUB parts will replace components normally used in manual scoring.

MSC is TOURNAMENT adaptable and competitive. The capability of the system to calculate, store and publish all player handicaps, similar to long golf and bowling, allows tournament play. This can result in personal achievement or the awarding of prizes. Each player receives a score sheet showing their scores for that day, with a request to optionally go to the website, for the purpose of establishing and maintaining a handicap for future play. This feature, unique to MINI-MATIC SMARTCLUB, will enhance the overall miniature golf business industry.

It is SECURE, since all play on the course is recorded in the website library by date and time, readouts are available for auditing all play. Loss of income due to attendant cash theft is eliminated, resulting in higher course profit.

Other variations and embodiments include the following:

1. The use of the RFID tag embedded in each golf tee to eliminate the need for ball-in-hole sensors. Since it is desirable to individually record the actual stroke score at each hole of a golf course, it is necessary for the recording device to accurately determine the first and subsequent strokes on each hole and to determine when the last stroke is taken at that hole. By having the club's RFID interrogation system recognize the identity of each tee via the embedded RFID tag response, the club's electronics can establish the start of a separate storage location for strokes at that numbered hole, including the final stroke when the ball falls into the hole. The knowledge that a final stroke has been taken at that hole can be assured when the club recognizes another RFID tee tag. At this point, the club's processing will then close and retain the number of strokes taken at the previous hole. The MSC system has been programmed according to this method, thus eliminating the need for a ball-in-hole signal to be generated and sent to the club by a device in the hole. The club's reading of the next tee RFID performs the ball-in-hole function.

2. The establishment and updating of a miniature golf handicap for MSC tournament use. In order to make some miniature golf courses more challenging, each golf putting hole may include variations of distance, curvature, altitude changes and obstructions requiring circumnavigation or avoidance from the tee to the hole. Along with distance, such curvature, altitude changes and obstructions (collectively known as "slope") can add to the difficulty of scoring. For each such hole, golfers proficient in playing competence can establish a published PAR value of score that represents an expert's ability to normally score. The MSC system records the actual scores a player achieves at each hole, and prints each score with its published PAR, along with the date, time of play and location of the course played. It also sends all that player's data via internet connection to the www.MINI-MATICgolf.com website for library storage. The player's scoring can be compared with the PAR at each hole, and a miniature golf handicap can be determined for that play. Such handicap may be as simple as a percentage of the difference between the actual score and the total course PAR, rounded to the nearest whole number. If a player decides to maintain such a handicap, he/she may enter the website, give the printed date, time, course location and scores, and request a handicap determination. The website will be programmed to perform this function, and to update the player's handicap upon receipt of additional future play. By this method, players may enter competitive tournaments at any course using MSC to achieve awards or recognition. Players may also maintain their handicaps as they play at any other MSC course, since all MSC play is recorded in the MSC library, and available to each MSC player as they identify their internet address, along with their most recent playing statistics of score, time and date of play and course location. This handicap feature for tournament play is new to the miniature golf industry.

3. The practice function, prior to recorded game play. The allowance of unrecorded practice at practice greens prior to playing at each of the courses numbered holes inhibits the recording and display of strokes taken before actually starting game play on the 18-hole course. The club programming allows game recording and display only after detecting one of the previously stored tee RFID tags.

4. The allowance of further practice of the last stroke(s) at holes, after recorded game play. The inclusion of "no-score" RFID tags at the bottom of each playing hole, to allow the player to inhibit further recorded storing while replaying final strokes at a hole, by dipping the club head into the hole to allow the club to read the "no-score" tag. Game scoring will continue normally when the club detects the next playing tee.

5. The 19th hole "no-score" function, to allow the 18-hole recorded play to be preserved. After completing normal 18-hole play, it is desirable to preserve the recording and display of the game score for ultimate printing and library storage, while allowing the player to attempt to gain a prize on the final ball-collecting hole used by some courses. The "no-score" RFID tag embedded into the 19th hole tee square will inhibit the reading of final stroke(s) taken at that tee, while preserving the recorded and displayed game scores within the club.

6. The putting clubs that have been developed are sealed to protect them from weather conditions and hard use by players. Since the club is powered by rechargeable batteries contained therein, a recharging device for a multiple of clubs has been developed. Each club is hung vertically by its putter head or may stand upright in a rack which contains positive and negative contacts for recharging, and also contains an LED or other signal device for each club to indicate the charge level. Clubs are easily inserted into the charger, and easily removed when fully charged. Presently, up to 18 clubs may be housed in an approximately 12"×8" size charger—several may be used for a larger number of clubs to be charged at the same time.

7. The score download is required in order to allow score sheet printing and to library record the scoring via internet connection to our website. A club reader has been developed to perform several functions:

a) to read the status of club charge prior to allowing a player to use the club for play;
b) to identify the club, presently by reading an attached bar code, which will start a clock for re-reading the start time;
c) to download all hole-by-hole and sum scores and time of play for each player, and the play complete time;
d) to preserve all daily and weekly play scoring, for owner audit of play; and
e) to read the status of charge after play, which will determine whether the club can be re-used for further subsequent play, or should be re-charged.

8. The club is programmed to erase all stored "marriages" and scores when its putter head is held near an "erase" RFID tag, for further subsequent player use. This allows clubs to be used repeatedly for subsequent players.

9. An alternative method of determining when the recorded scoring on a hole is complete has also been implemented. Each individual tee plaque RFID tag has been recorded separately in the club, to allow the microprocessor to recognize that a tee tag different from the previous one has been detected. When this new tag is detected, this fact causes the club to cease recording strokes on the previous hole storage, preserve such hole sum for later print and web recording, and open a new storage location for the next observed tee plaque RFID tag. This eliminates the need for any ball-in-hole transmitting device to signal the club that scoring on a hole has been completed.

BRIEF DESCRIPTION OF THE DRAWINGS

The above and other objects and the nature and advantages of the present invention will become more apparent from the following detailed description of preferred embodiments taken in conjunction with the drawings, in which:

FIG. 7 is a cross section of an exemplary bevel in a golf fairway;

FIG. 8 is a block diagram of the electrical communications in the golf game system of FIG. 1;

FIG. 10 is a drawing of a cross section of the tee area of FIG. 9.

DETAILED DESCRIPTION OF THE PREFERRED EMBODIMENTS

Figure 1:
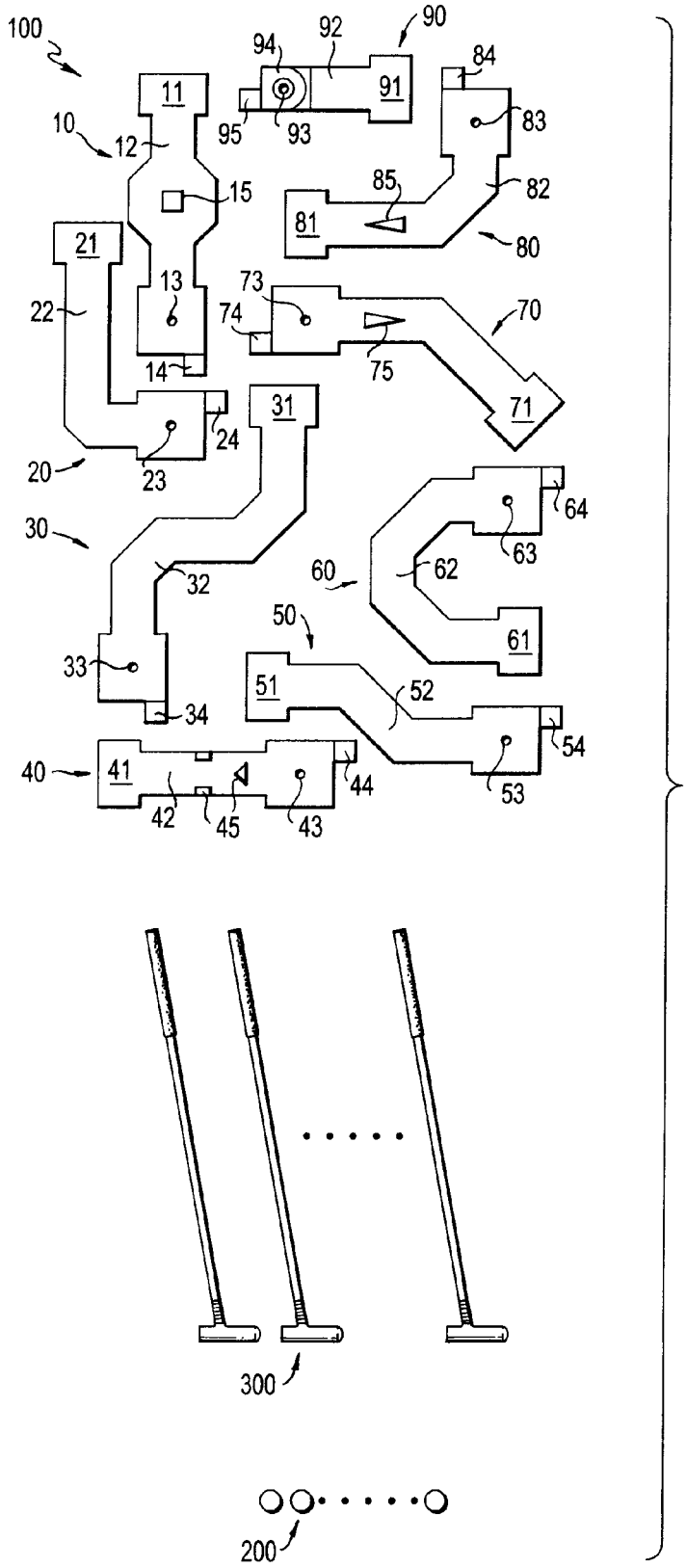
FIG. 1 is a plan view of a mini-golf course according to an exemplary embodiment of the present invention.

Preferred embodiments of the invention will be set forth in detail with reference to the drawings, in which like reference numerals refer to like elements or steps throughout.

The invention described in the drawing figures below relates to a mini golf game.

The golf course has a plurality of holes. At the start of the game, an attendant supplies each player with a golf ball from a plurality of balls. Each of the balls has a passive radio-frequency identification (RFID) chip embedded therein to respond to golf clubs and holes. The identification number in each ball is different from the identification numbers of other balls. An example of a passive RFID chip of an appropriate size is produced by Texas Instruments, Inc., part number RI-I03-112A.

After receiving a golf ball, the player selects a golf club from a plurality of clubs available at the course. Each of the clubs may have a sensor to read the identification number of the ball to pair with the ball for the entire game. The club also contains an internal force sensor in the club's head, which senses the act of the club striking the ball, and transmits a low power RFID interrogation to the ball. A receiver in the club decodes the ball's response as a stroke and retains a memory of each stroke taken. The club also has a display to show the current stroke score.

Each of the golf holes is encoded with a digital identification code. Each golf hole has a golf cup to receive the ball. The golf hole may also include a force sensor and a low power RFID interrogator located at the bottom of the hole. When the ball falls into the golf hole, the force sensor triggers the low power RFID interrogator to read the response of the impact of the ball falling into the golf cup to determine the ball's identification and transmit the ball's identification code, along with the hole's identification code, to a receiver located in the club. The club then stores the number of strokes taken until it receives a ball-in-hole signal from the hole. The score is stored within the club's memory as the hole score for that hole. The club's memory then starts separately recording the score for the next hole.

The play of the game progresses in the manner described above by each player until all of the balls are retained in the final hole. When play is concluded, the club transmits the scores for each hole as well as the final score from its memory to a printer at the vicinity of the final hole. The printer then prints that player's hole-by-hole and total score for the player's retention and library scoring. After transmitting all such recorded scores, the club clears its memory to be ready for use by a future player.

FIG. 1 shows a plan view of a 9-hole mini golf course 100 according to an exemplary embodiment of the present invention. As shown in FIG. 1, the golf course 100 includes nine hole areas 10, 20, 30, 40, 50, 60, 70, 80 and 90 and a printer 95. Each of the areas 10, 20 30, 40, 50, 60, 70, 80 and 90 generally has a tee area, a green area, and a golf hole. The golf game can accommodate a plurality of players, wherein each player strikes a golf ball with a club or putts from the tee area at one end of the green, into the hole at the other end of the green. Obstructions may be strategically placed in the greens and the greens themselves may have various shapes and slopes to provide different degrees of difficulty for the players.

Specifically, the first area 10 includes a tee area 11, a green 12 with an obstruction 15, and a hole 13. The second area 20 includes a tee area 21, a green 22, and a hole 23. The third area 30 includes a tee area 31, a green 32, and a hole 33. The fourth area 40 includes a tee area 41, a green 42 with obstructions 45, and a hole 43. The fifth area 50 includes a tee area 51, a green 52, and a hole 53. The sixth area 60 includes a tee area 61, a green 62, and a hole 63. The seventh area 70 includes a tee area 71, a green 72 with an obstruction 75, and a hole 73. The eighth area 80 includes a tee area 81, a green 82 with an obstruction 85, and a hole 83. The ninth area 90 includes a tee area 91, a green 92, and a hole 93. The ninth area 90 is the last area of the golf game, thus also includes a target 94 to collect the balls for later use and a printer 95 for printing score sheets. Similarly, an 18 hole course would have tee, green, and a hole, with a printer at the final hole area. Each of the balls 200 has a ball identification code different from other ball identification codes, and each of the holes has a hole identification code different from other hole identification codes. Clubs 300 are also shown.

Figure 2:
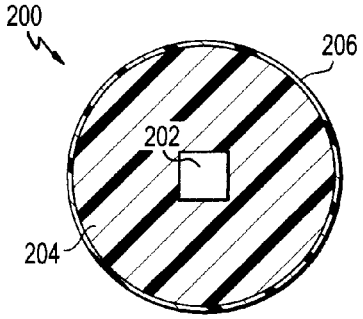
FIG. 2 is a drawing of a cross section of a golf ball according to an exemplary embodiment of the present invention.

Prior to playing, each player receives a golf ball 200, shown in FIG. 2. The ball 200 includes a passive RFID unit 201 with its unique digital identification code, or other electronic device capable of responding to an interrogator. The ball 200 is filled with material 202 transparent to radio waves and covered by a shell 203. In one example, each golf ball in a group playing together is painted a color different from other golf balls so that the players are able to differential their ball from other balls in the group.

Figure 3A:
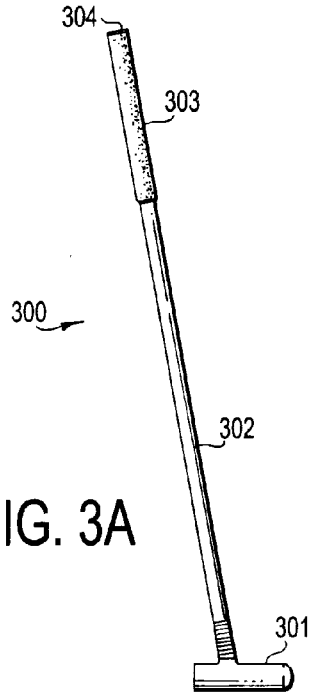
FIG. 3A is a profile view of a club according to an exemplary embodiment of the present invention.

FIG. 3A shows a profile of a club (or a putter) according to an exemplary embodiment of the present invention. The club 300 includes a head 301, a shaft 302, a handle 303, and a club-top display 304. One end of the shaft 302 is attached to the head 301 and the other end of the shaft 302 is attached to the handle 303. The club-top display 304 is at the end of the grip 303 to display the player's score. The player would hold the handle 303 and hit a golf ball with the head 301, and the display 304 displays the score. The head 301 has symmetrical striking surfaces to accommodate left or right-handed players. The club or putter 300 can be covered in a sealant 320 to seal it against weather conditions.

Figure 3B:
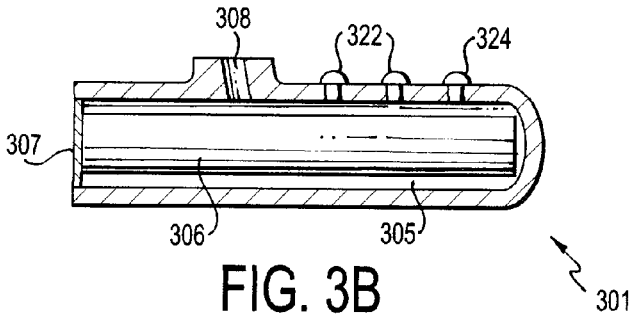
FIG. 3B is a drawing of a cross section of the head of the club shown in FIG. 3A.

FIG. 3B shows the internal construction of the head 301. Referring to FIG. 3B, the head 301 includes an outer shell forming a cavity 305 therein. The cavity 305 contains an electronic device 306 which includes a low power RFID interrogator and receiver to read the ball's unique digital code, a piezoelectric or other type of force sensor (not shown) to activate it when the head 301 impacts the ball, and a processor. The head 301 may also include a removable plug 307 for allowing access to the electronic device 306 and a hole 308 for allowing wiring cables to connect with other components in the club. The head 301 may also have charging contacts 322 and an LED 324 to show the charging status.

Figure 3C:
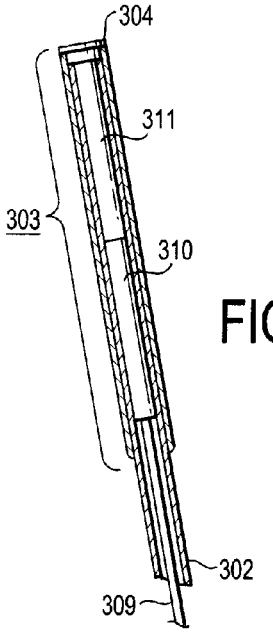
FIG. 3C is a drawing of the handle of the club shown in FIG. 3A.

FIG. 3C shows the club handle 303, including an electronics package 310 to activate the electronic device 306 in the head 301, communicate with the printer at the final hole, and count the number of strokes. The handle 303 also includes rechargeable or replaceable batteries 311, wiring cables 309 for connecting to the electronic device 306 in the head 301, and a club-top display 304 for displaying the player's scores. The display 304 may also be removable to allow access to replaceable batteries. In another embodiment, all electronics and batteries may be housed in the putting head.

Figure 3D:
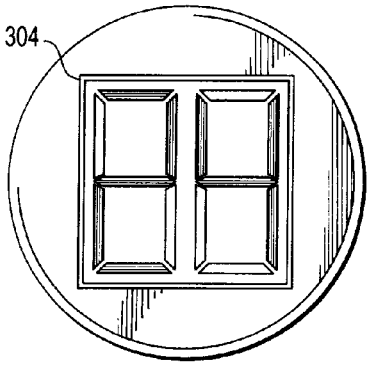
FIG. 3D is an exemplary score display on the top of the club.

FIG. 3D illustrates the club-top display 304. The display 304 shows a cumulative game score for the current game in progress. Even though the display 304 is shown to be at the end of the club, it could also be at another location on the club, such as on the side of the handle 303 or on the putting head. Such displays are commercially available from several sources, such as the dual digit numeric LED displays (part number XZFMYK14A2) produced by SunLED Corporation. Other display types, such as LCD or OLED, may be used.

Figure 4:
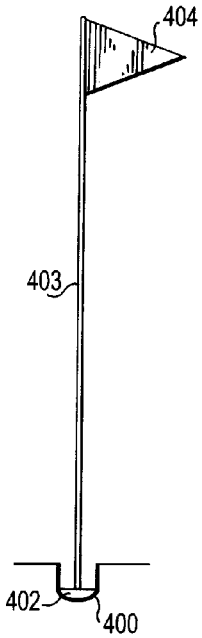
FIG. 4 is a drawing of a golf hole according to an exemplary embodiment of the present invention.

FIG. 4 shows a golf hole 400, which represents each of the golf holes 13, 23, 33, 43, 53, 63, 73, 83 and 93 of FIG. 1. The golf hole 400 may include a replaceable battery-driven electronic device 402, a pole having an antenna 403 and a flag 404. A portion of the electronic device 402 can be functionally identical with that in each club head 301, to allow the golf hole to sense the drop of a golf ball into the hole via a force sensor. The electronic device 402 also interrogates or detects the identification code of the ball, and communicates the ball's and the hole's identification codes to the club via an antenna 403.

Figure 5:
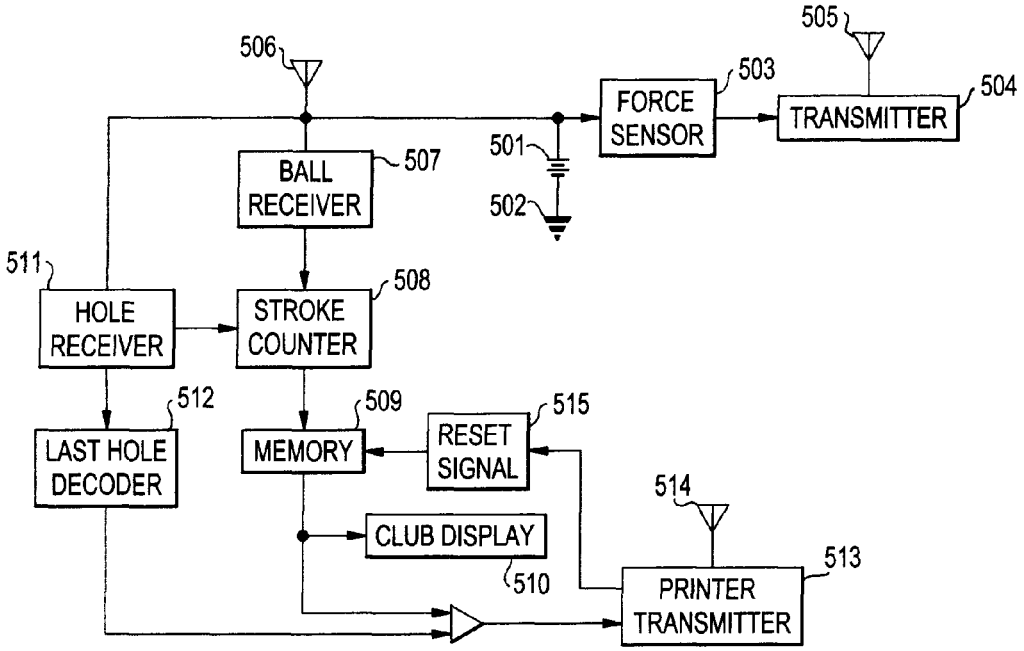
FIG. 5 is a diagram of an electronic device in a club according to another exemplary embodiment of the present invention.

FIG. 5 is a schematic block diagram of the electronic device in the club head and handle. The device 500 includes a battery 501, connected to a common ground 502, for supplying power to all components. When the force sensor 503 detects an impact with a golf ball, it energizes low-power transmitter 504 to transmit an interrogation signal through antenna 505. The passive RFID, or other electronic device, within the ball responds with its code through antenna 506 in the club head. Ball receiver 507 receives the response, compares the ball signal contained therein and, if the ball identity is correct, registers a stroke in stroke counter 508. To prevent transmissions from other balls affecting a club's score, the first stroke taken by each club in a round of play establishes the identity of the ball's code to be accepted by that club's ball receiver 507. Further strokes by the same club update the count in counter 508, and send the count to memory 509 as the hole score when a ball-in-hole signal is received from hole receiver 511.

When the ball falls into a hole, the hole receiver 511 reads the ball's identification code and sends the ball's and the hole's identification codes to the club through antenna 506. The counter 508 in the club, upon receiving the ball-in-the-hole signal from the hole, preserves the score of that hole in the memory 509. The aggregated sum of all hole scores in progress is sent by memory 509 to the club display 510 to display to the player. When a signal from the final hole is received by last hole decoder 512, the memory 509 is triggered to download all hole scores to printer transmitter 513 through the antenna 514 in the club. When an "erase" RFID signal is received, a reset signal 515 is sent to memory 509 to reset all memory to zero.

Figure 6:
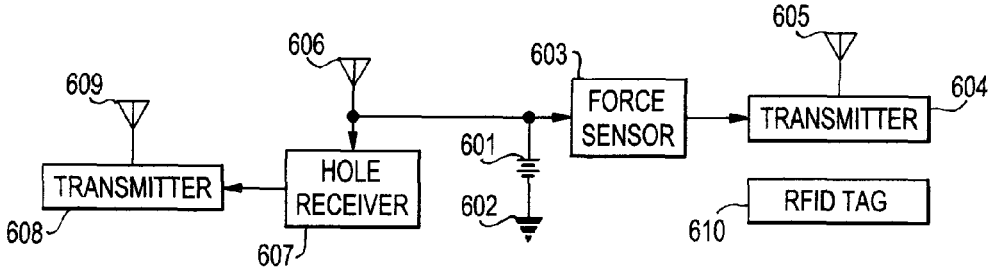
FIG. 6 is a diagram of an electronic device in a golf hole according to another exemplary embodiment of the present invention.

FIG. 6 is a schematic block diagram of the electronic device which may be used in each golf hole. Battery 601 provides power to all circuits through common ground 602. Force sensor 603 detects the fall of a ball into the hole, energizes the transmitter 604 to transmit an interrogation signal through the antenna 605 to the ball. The ball responds by transmitting a signal including the ball's identification code to the hole's receiver 607. The transmitter 608 in the hole then transmits both the hole's and the ball's codes through the antenna 609 to the player's club. In addition, or alternatively, an RFID tag 610 can be provided to identify each hole.

FIG. 7 shows a cross section of an exemplary fairway 700 and an exemplary bevel 701 that can be employed for the fairways 12, 22, 32, 42, 52, 62, 72, 82 and 92 of FIG. 1. Each of the fairways includes a green area (typically synthetic grass) and vertical sides on two sides of the green area to prevent the golf balls from falling out of the fairway. As shown in FIG. 7, the fairway 700 includes a synthetic-grass green area 703, a vertical side 702 and the bevel 701. The bevel 701 may be a strip of plastic or hard rubber, having a triangular shape in its cross section, and is selectively installed at the edge of a vertical side 702 and the green area 703 to prevent the golf balls from coming to rest against such vertical sides. It is common practice to use clubs to move the balls out several inches so that the balls can be putted properly. Such an action may cause a false stroke to be registered. The bevels such as the bevel 701 eliminate the need for moving the balls with a club.

FIG. 8 is a block diagram of the communications that transpire between components of the entire interactive golf game system with automatic scoring. Clubs 300, balls 200, holes 400 and printer 95 each transmit and respond as previously described. The reference numbers of the components in FIG. 8 are correspondent to those in FIG. 1. Golf balls 200 sense interrogations from clubs 300 and holes 400 and respond. Clubs 300 transmit scores to the printer 95. A device 802 configured to function as a reader, a charger, or both is provided. Tee tags 803 are read by clubs to start scoring at each hole. An erase RFID tag 804 can be provided; when a club is held up to the tag 804, the club erases the pairing of the club and a ball to which the club has been paired.

Testing of the entire system can be accomplished by an attendant selecting a ball and club, playing through all the holes of the game to receive the printed score sheet, and then tapping each remaining club head with a ball to view a club handle score response. After viewing such score, the attendant will clear each club memory by using a portable device that transmits an "erase" signal. Batteries, or entire devices, that fail to operate may be replaced from spares on hand. The testing procedure can be repeated at intervals during course operating hours. Several methods may be used to preserve battery energy and to identify low charge in each club and hole device. A timer may be included in club display 509 to limit the time the display is shown to only several seconds after a stroke is recorded. Each club device may also measure battery voltage, and contain a circuit to cause the display to show a low battery indication such as a "C" in the display, so the operator will be warned to replace batteries in the club during tests. Similarly, each hole device may measure battery voltage, and include in its transmission a code to allow the display to show a low battery indication such as an "H" in the club display, to warn the operator to replace hole device batteries. Furthermore, the letter "C" can be in the left digit of the club display and the letter "H" can be in the right digit of the club display.

Figure 9:
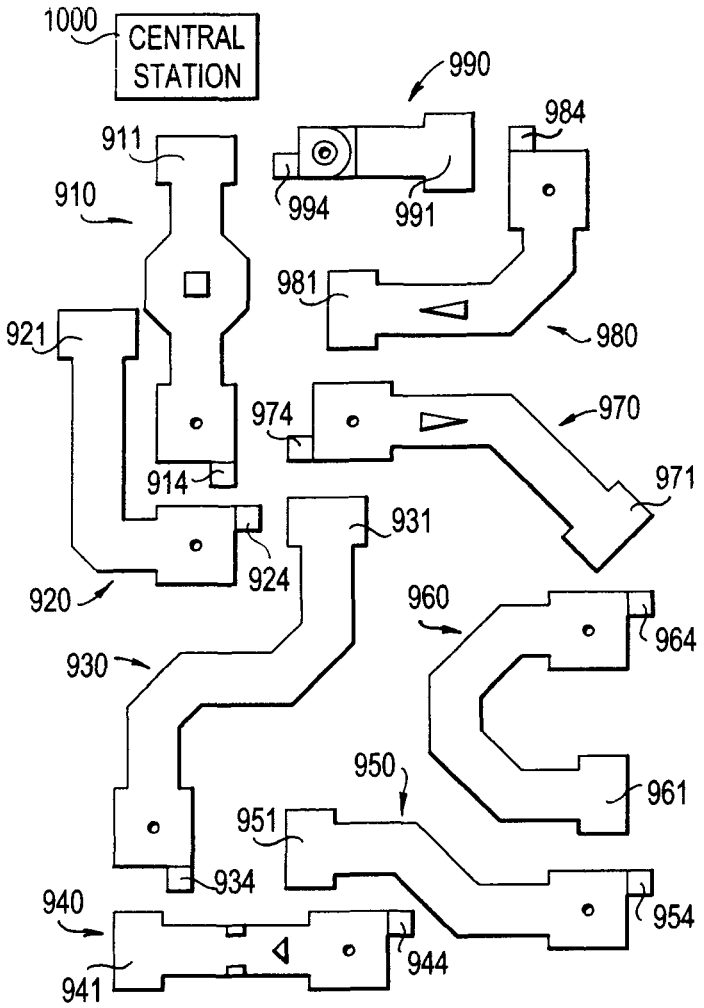
FIG. 9 is a plan view of a mini-golf course according to another exemplary embodiment of the present invention.

FIG. 9 shows a plan view of a mini golf course 900 according to another exemplary embodiment of the present invention. The golf course 900 is an expansion of the course 100 of FIG. 1, in that it further includes a central computer station 1000 and an electronic message board at each of the holes. Referring to FIG. 9, the golf course 900 includes nine hole areas 910, 920, 930, 940, 950, 960, 970, 980 and 990 and the central station 1000. The central station 1000 includes a computer for receiving names of the players, a receiver for receiving signals, and a transmitter for transmitting signals. The names of the players can be entered by a keyboard or touch-screen. As the computer signals a dispenser to issue a golf ball to each of the players, the identification codes of each of the dispensed balls will be read into the computer of the central station 1000 such that the computer can link the names of the players to their respective golf balls. The balls may have the same structure as that in FIG. 2. Each of the players selects a club. Each of the club may have the same structure as the club shown in FIGS. 3A-3D.

As shown in FIG. 9, each of the hole areas 910, 920, 930, 940, 950, 960, 970, 980 and 990 includes a tee, a green, and a hole. Each of the hole areas further includes an electronic message board located near the hole. The message boards in FIG. 9 are labeled 914, 924, 934, 944, 954, 964, 974, 984 and 994. The message boards can be either LED for outdoor courses or plasma/LCD for indoor courses. The message boards receive signals from the computer of the central station 1000 to display the names of the players and interactive statements to encourage player's enjoyment.

In FIG. 9, the tee areas are labeled 911, 921, 931, 941, 951, 961, 971, 981 and 991 for the respective hole areas. Each of the tee areas has a tee sensor for sensing the presence of the players. FIG. 10 shows a cross-sectional view of an exemplary tee for the tees in FIG. 9. As shown in FIG. 10, the tee includes a central region 1010 for placing the golf balls, a left region 1020 and a right region 1030 for the players to stand on. Under the central region 1010 is an interrogator 1012 for reading the identification code of the ball placed on the tee and a transmitter 1014 for communicating with the central station 1000 of FIG. 9. Under the left region 1020 is a first tee force sensor 1022 and under the right region 1030 is a second tee force sensor 1032. Any types of force sensors, interrogators, and transmitters available in the market can be used for the force sensors, interrogators, and transmitters in the tees. In operation, as a player places a ball on the tee in the central region 1010 and stands on the left region 1020 (or right region 1030), the first force sensor 1022 (or the second force sensor 1032) senses the weight of the player, which causes the interrogator 1012 in the central region 1010 to read the ball's identification code. The transmitter 1014 in the central tee region 1010 then sends the ball's identification code to the central station 1000 to signify that the player is about to play in this hole area. A transmitter at the central station 1000 then sends a signal to the message board of the hole to display a message for that player whose name is linked to the ball's code.

Referring again to FIG. 9, as indicated above, each of the golf holes areas 910, 920, 930, 940, 950, 960, 970, 980 has a hole. Each hole has a structure similar to that in FIG. 4. The hole includes a flag pole, a cup for receiving the ball, and a ball-in-the-hole sensor. The ball-in-the-hole sensor for the holes in the golf course 900 sends a signal to the central station 1000 such that the central station will keep track of the progress of the game.

After the central station 1000 receives the ball-in-the-hole signals for each of the golf balls, a score sheet is printed, giving the hole-by-hole and final score for each of the players.

The expansion described in FIG. 9 can be added at any later time to the interactive golf game with automatic scoring described in FIG. 1, without major course rebuilding, to increase player enjoyment.

While preferred embodiments of the invention have been set forth above, those skilled in the art who have reviewed the present disclosure will readily appreciate that other embodiments or terminology can be realized within the scope of the invention. For example, although the invention described above is for mini-golf, the invention also work for a regular golf game, cricket, or any game with balls, clubs to strike the balls, and holes or receptacles into which the balls may fall. Therefore, the present invention should be construed as limited only by the appended claims.

I claim:

1. A game system, comprising:

at least one ball, said at least one ball comprising a passive electronic identification unit storing a ball, identification code identifying said at least one ball;

at least one club comprising a striking sensor for sensing a striking action of the at least one club on the at least one ball, an electronic interrogator for interrogating the passive electronic identification unit to retrieve the ball identification code, and a score display for displaying a score related to the striking action; and at least one hole area comprising:

a tee for placing the at least one ball, and a hole for receiving the at least one ball, the hole having at least one of a tag readable by the at least one club and a ball-in-the-hole sensor for communicating with the at least one club;

wherein the at least ball comprises a plurality of balls, each of the balls having a ball identification code different from other ball identification codes;

wherein the at least one club comprises a plurality of clubs;

wherein the at least one hole area comprises a plurality of hole areas, the tee for each of the hole areas having a hole identification code different from the hole identification codes of other holes; and wherein each of the plurality of clubs is configured to read the ball identification code of one of the plurality of balls to pair with said one of the plurality of balls for an entirety of a game and to erase such pairing after the game.

2. The game system of claim 1, further comprising an erase tag readable by each of the plurality of clubs to instruct said each of the plurality of clubs to erase the pairing.

3. A game system, comprising:

at least one ball;

at least one club comprising a striking sensor for sensing a striking action of the at least one club on the at least one ball, a tag reader, and a score display for displaying a score related to the striking action; and at least one hole area comprising:

a tee for placing the at least one ball, a hole for receiving the at least one ball, and an electronically identifiable tag, readable by the tag reader in the at least one club, identifying said at least one hole area;

wherein the at least one club is configured to record a score separately for each of said at least one hole area in response to reading the tag.

4. A game system, comprising:

at least one ball;

at least one club comprising a striking sensor for sensing a striking action of the at least one club on the at least one ball, and a score display for displaying a score related to the striking action;

at least one hole area comprising:

a tee for placing the at least one ball, and a hole for receiving the at least one ball, the hole having at least one of an electronic tag readable by the at least one club and an electronic ball-in-the-hole sensor for communicating with the at least one club; and a course tee tag, wherein practice strokes prior to game play at course holes are inhibited from storage and display until the course tee tag is recognized by the club;

wherein the at least one club and the at least one ball are sealed to protect the at east one club and ball from weather conditions.

5. A game system, comprising:

at least one ball;

a least one club comprising a striking sensor for sensing a striking action of the at least one club on the at least one ball, and a score display for displaying a score related to the striking action;

at least one hole area comprising:

a tee for placing the at least one ball, and a hole for receiving the at least one ball, the hole having at least one of an electronic tag readable by the at least on club and an electronic haft-in-the-hole sensor for communicating with the at least one club; and a "no-score" tag, wherein practice strokes after normal conclusion of hole strokes are inhibited from storage and display by allowing the club to read the "no-score" tag at either an extra "ball-collecting" hole or for replaying final stroke(s) at any course hole, until a subsequent tag is read by the club;

wherein the at least one club and the at least one ball are sealed to protect the at least one club and ball from weather conditions.

6. A game system, comprising:

at least one ball, said at least one ball comprising a passive electronic identification unit storing a ball identification code identifying said at least one ball, wherein the passive electronic identification unit requires no power source to provide power thereto;

at least one club comprising a striking sensor for sensing a striking action of the at least one club on the at least one ball, an electronic interrogator for interrogating the passive electronic identification unit to retrieve the ball identification code, and a score display for displaying a score related to the striking action; and at least one hole area comprising:

a tee for placing the at least one ball, and a hole for receiving the at least one ball;

wherein the at least one ball comprises a plurality of balls, each of the balls having a ball identification code different from other ball identification codes;

wherein the at least one club comprises a plurality of clubs; and wherein each of the plurality of clubs is configured to read the ball identification code of one of the plurality of balls to pair with said one of the plurality of balls for an entirety of a game and to erase such pairing after the game.

7. The game system of claim 6, further comprising an erase tag readable by each of the plurality of clubs to instruct said each of the plurality of clubs to erase the pairing.

8. A game system, comprising:

at least one ball;

at least one club comprising a striking sensor for sensing a striking action of the at least one club on the at least one ball, a tag reader, and a score display for displaying a score related to the striking action; and at least one hole area comprising:

a tee for placing the at least one ball, a hole for receiving the at least one ball, and an electronically identifiable tag, readable by the tag reader in the at least one club, identifying said at least one hole area.

9. A game system, comprising:

at least one ball;

at least one club comprising a striking sensor for sensing a striking action of the at least one club on the at least one ball, and a score display for displaying a score related to the striking action;

at least one hole area comprising:

a tee for placing the at least one ball, and a hole for receiving the at least one ball, and a course tee tag, wherein practice strokes prior to game play at course holes are inhibited from storage and display until the course tee tag is recognized by the club.

10. A game system, comprising:

at least one ball;

at least one club comprising a striking sensor for sensing a striking action of the at least one club on the at least one ball, and a score display for displaying a score related to the striking action; and at least one hole area comprising:

a tee for placing the at least one ball, and a hole for receiving the at least one ball, and a "no-score" tag, wherein practice strokes after normal conclusion of hole strokes are inhibited from storage and display by allowing the club to read the "no-score" tag at either an extra "ball-collecting" hole or for replaying final stroke(s) at any course hole, until a subsequent tag is read by the club.

11. A game system, comprising:

at least one ball;

at least one club comprising a striking sensor for sensing a striking action of the at least one club on the at least one ball, and a score display for displaying a score related to the striking action; and at least one hole area comprising:

a tee for placing the at least one ball, and a hole for receiving the at least one ball, the hole having an electronic tag readable by the at least one club.

12. The game system of claim 11, wherein the hole also has an electronic ball-in-the-hole sensor for communicating with the at least one club.

13. The game system of claim 11, wherein the at least one club comprises a rechargeable battery.

14. The game system of claim 13, further comprising a charger for the rechargeable battery.

15. The game system of claim 11, wherein the at least one club comprises a replaceable battery.

* * * * *